United States Patent [19]

Mejias

[11] Patent Number: 4,987,654

[45] Date of Patent: Jan. 29, 1991

[54] DUAL-RELEASE FASTENER FOR STRAP ENDS

[75] Inventor: André Mejias, Vevey, Switzerland

[73] Assignee: Premiere de Tabbah SA, Fribourg, Switzerland

[21] Appl. No.: 260,394

[22] Filed: Oct. 20, 1988

[30] Foreign Application Priority Data

Nov. 12, 1987 [EP] European Pat. Off. ..... 87810653.3

[51] Int. Cl.[5] ..... A44B 1/04

[52] U.S. Cl. ..... 24/170; 24/191; 24/265 BC

[58] Field of Search ..... 24/170, 68 E, 68 F, 24/68 J, 69 ST, 69 R, 69 CT, 69 CF, 69 TM, 69 TS, 69 J, 69 AT, 69 FP, 69 SB, 69 EF, 71 J, 71 R, 168, 173, 191, 193, 197, 182, 184, 265 BC, 265 EC, 265 WS

[56] References Cited

U.S. PATENT DOCUMENTS

| | | | |
|---|---|---|---|
| 530,960 | 12/1894 | McGriff | 24/191 |
| 623,489 | 4/1899 | Mollay | 24/191 |
| 1,324,080 | 12/1919 | Stephens | 24/170 |
| 1,393,425 | 10/1921 | Buchsbaum | 24/170 |
| 1,850,722 | 3/1932 | Kestenman | 24/191 |

*Primary Examiner*—Laurie K. Cranmer

*Attorney, Agent, or Firm*—Marks Murase & White

[57] ABSTRACT

A dual-release fastener which permits the use of straps without fastening holes, eliminating the risk of the straps breaking. The fastener has a set of levers disposed on opposite sides of the first strap end which is being releasably secured. The second strap end is affixed to the fastening mechanism. The set of levers are coupled together so that the free strap end can be released by either lever.

9 Claims, 1 Drawing Sheet

DUAL-RELEASE FASTENER FOR STRAP ENDS

BACKGROUND OF THE INVENTION

The present invention relates to a fastener or clasp for connecting two flexible straps, more especially flexible straps made of leather. Such a fastener may be used, for example, in a bracelet or a belt.

In known fastening means for connecting flexible, leather straps, the straps include boles which are provided in order to accommodate a tongue when the straps are connected together. However, this conventional design has the disadvantage that the straps are liable to split, generally at the place where a hole is situated, because of the strain to which they are subjected.

SUMMARY OF THE INVENTION

In consequence, the present invention proposes to achieve a tongueless fastener for connecting flexible straps which do not have any holes, the fastener permitting the elimination of any splitting of the straps. To achieve this object, the fastener of the invention comprises a first means, having a passage for a first strap and permitting the length of this strap to be set, and a second means pivotally connected to the first means, at one end of which which there is attached a second strap, the first means comprising a securement mechanism which permits the first strap to be tightened and retained in position relative to the second means.

During the connecting procedure, the free strap is inserted into a guide passage which is included in a component part of the fastener and is limited by the tightening lever. When the desired length of the inserted free strap is attained, the tightening lever is pressed against the portion of this strap which emerges from the passage, and the strap is tightened by this lever against the passage and against the end of a second component part of the fastener, to which end there is pivotally connected the end of the second strap. The tension in the straps maintains the pressed lever in its locked position. The second component part, in the form of a lever, permits the fastener to be opened as a result of a pivotal movement about a pivot joint. The above statements clearly show that the fastener of the present invention permits straps with no holes to be provided, the free strap simply being held securely by means of a lever under the influence of the traction force existing in this strap when it is being worn. Such a construction is especially suitable for eliminating all risk of the straps breaking.

BRIEF DESCRIPTION OF THE DRAWINGS

The invention will be described in more detail hereinafter with reference to the drawing of one embodiment.

DESCRIPTION OF THE PREFERRED EMBODIMENTS

Figure 1:
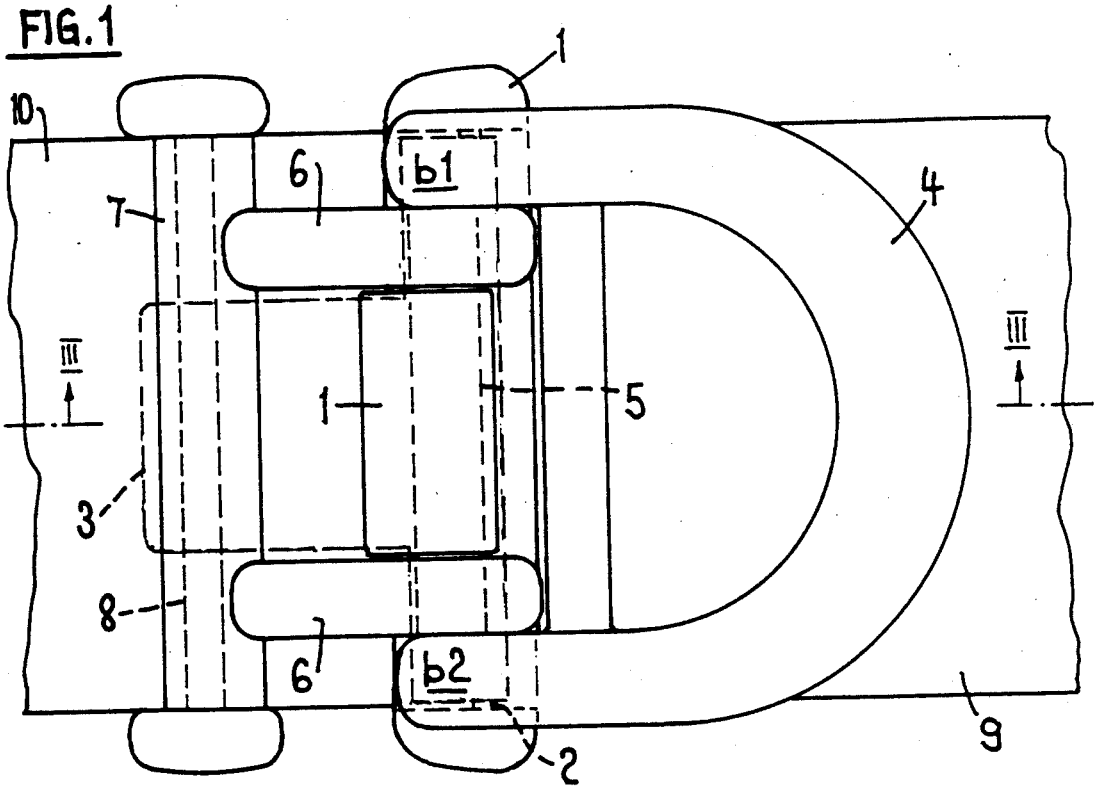
FIG. 1 is a plan view of the fastener according to the invention.

The Figures show that the fastener comprises of the present invention a U-shaped component part 1 in the lower portion of which there is mounted a spindle 2 between the two arms of the "U", a tightening lever 3 being pivotally connected to the spindle 2. The upper portion of the U-shaped component part is hook-shaped, as illustrated more clearly in FIG. 3. The U-shaped portion of component 1 defines a guide passage which is closed at the bottom end by the portion of the lever 3 which is engaged on the spindle 2.

In addition, the fastener comprises a loop-shaped component part 4 which serves as a lever, this component part comprising a spindle 5 mounted between the ends b1 and b2 of the loop 4. This spindle 5 engages in the open neck of the hook-shaped portion of the component part 1. The component part 4 also comprises cross-piece members 6 which rigidly connect the loop-shaped portion of 4 to an open cylinder containing a spindle 8, about which there is pivotally mounted the end of the second strap 10. When the fastener is in its open position, the lever 3 is pressed downwardly in FIGS. 2 and 3, in the direction of the arrow, and, when the strap 9 is inserted into the passage in the component part 1, as mentioned above, it is substantially in a horizontal position or slightly inclined downwardly. When the desired length of the strap 9 is attained, the lever 3 is pressed upwardly into the position illustrated in FIGS. 2 and 3. In this position, the lever 3 presses the strap 9 both against the base of the hook-shaped portion of the component part 1 and against the open cylinder 7, and this phenomenon is as a result of the traction exerted upon the straps 9 and 10 in opposite directions, as indicated by the arrows f1 and f2 in FIG. 3. The resultant of these traction forces can be expressed as a torque seeking to pivot the lever 3 upwardly as shown in FIG. 3, thereby producing the force for tightening the strap 9 in the passage and against the open cylinder 7. The higher the forces f1 and f2, the greater the tightening force. To increase the friction between the lever 3 and the strap 9, it is possible to provide the lever 3 with a rough internal surface by incorporating grooves therein, for example, or with any other suitable configuration.

Figure 2:
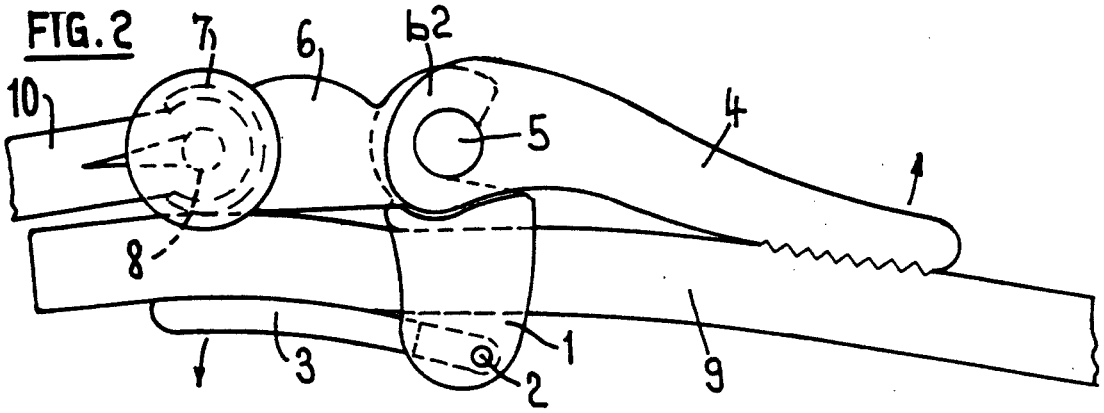
FIG. 2 is a side elevational view of the fastener shown in FIG. 1.
Figure 3:
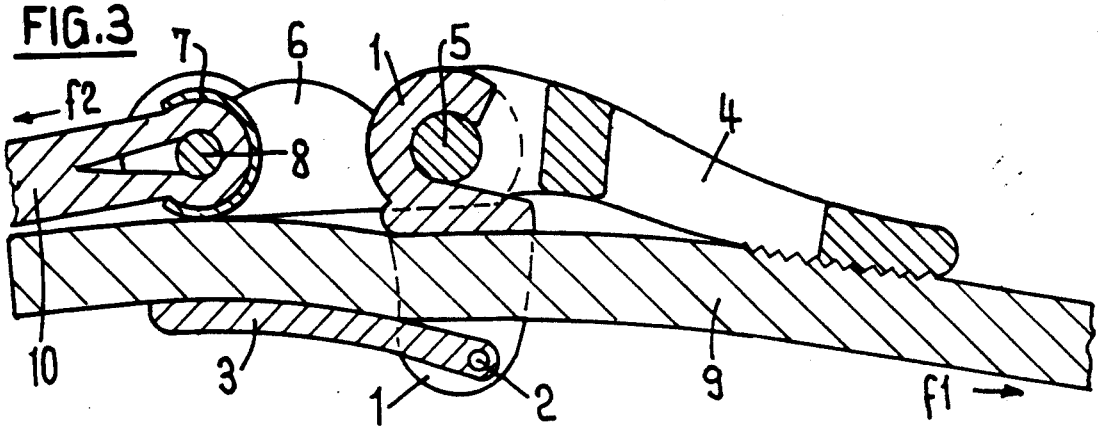
FIG. 3 is a cross-sectional view taken along the line III–III of FIG. 1.

To open the fastener, it is sufficient to seek to pivot the lever 4 in the direction of the arrow in FIG. 2. This action permits the component part 4, 6, 7 to pivot slightly about its spindle 5, which is engaged in the neck of the book-shaped portion of the component part 1, this pivotal movement causing the open cylinder 7 to tilt downwardly, with the result that the strap 9 causes the lever 3 to pivot downwardly and disengages the lever 3 from its looked position. The strap 9 is then released.

As indicated above, the fastener may be intended for use as a bracelet, a belt, etc. It does not have a tongue, and the straps do not have any holes. Securement is effected by tightening the free strap, with the result that all wear is eliminated and any risk of the strap breaking is prevented.

What is claimed:

1. A dual-release fastener for connecting first and second ends of a strap, comprising:

a first element defining a passage through which said first strap end is slidably received;

a first lever cooperating with said first element to releasably retain said first strap end in a fixed position relative thereto;

a second element pivotally connected to said first element and attached to said second strap end, said second element being coupled to said first lever for releasing the same upon pivoting of said second element with respect to said first element; and a second lever rigidly connected to said second element to permit selective rotation of said second element relatively to said first element, said first and second levers being disposed on opposite sides of said first strap end, thereby permitting release of said first strap end from either of said opposite sides; wherein said first element comprises:

a U-shaped lower portion having two arms which form an open end;

a first spindle connecting said arms across said open end to define said passage through which said first strap end is slidably received; and a hook-shaped upper portion to which said second element is pivotally connected.

2. A fastener according to claim 1, wherein said first lever is pivotally mounted on said first spindle, permitting the portion of said first strap end which emerges from said passage to be tightened relative to said second element in order to secure said first strap end in said fastener.

3. A fastener according to claim 2, wherein the surface of said first lever which contacts said first strap end is roughened to increase the adherence of said first lever to said first strap end.

4. A fastener according to claim 3, wherein said roughened surface comprises a grooved surface.

5. A fastener according to claim 1, wherein said second lever defines an open loop-shaped portion with a second spindle connecting the open end and said second element is pivotally connected to said first element by placing said second spindle in the hook-shaped upper portion of said first element.

6. A fastener according to claim 5, wherein said second lever permits said first strap end to be released as a result of the exertion thereupon of a traction force perpendicular to the plane of said first strap end, this force seeking to pivot the second element about said second spindle in an anti-clockwise direction, with the result that, by tightening the portion of said first strap end relative to the element, said first lever is disengaged.

7. A fastener according to claim 1, wherein said second lever is rigidly connected to said second element by two crosspieces.

8. A bracelet comprising a first strap end, a second strap end, and a dual-release fastener for connecting said first and second strap ends comprising:

a first element defining a passage through which said first strap end is slidably received;

a first lever cooperating with said first element to releasably retain said first strap end in a fixed position relative thereto;

a second element pivotally connected to said first element and attached to said second strap end, said second element being coupled to said first lever for releasing the same upon pivoting of said second element with respect to said first element; and a second lever rigidly connected to said second element to permit selective rotation of said second element relatively to said first element, said first and second levers being disposed on opposite sides of said first strap end, thereby permitting release of said first strap end from either of said opposite sides.

9. A belt comprising a first strap end, a second strap end, and a dual-release fastener for connecting said first and second strap end comprising:

a first element defining a passage through which said first strap end is slidably received;

a first lever cooperating with said first element to releasably retain said first strap end in a fixed position relative thereto;

a second element pivotally connected to said first element and attached to said second strap end, said second element being coupled to said first lever for releasing the same upon pivoting of said second element with respect to said first element; and a second lever rigidly connected to said second element to permit selective rotation of said second element relatively to said first element, said first and second levers being disposed on opposite sides of said first strap end, thereby permitting release of said first strap end from either of said opposite sides.

* * * * *